United States Patent [19]

Grawi

[11] Patent Number: 4,481,856

[45] Date of Patent: Nov. 13, 1984

[54] STRINGED INSTRUMENT FOR ATTACHMENT TO AN ELECTRONIC TRANSDUCER

[76] Inventor: Robert S. Grawi, 655 6th Ave., Rm. 215, New York, N.Y. 10010

[21] Appl. No.: 415,589

[22] Filed: Sep. 7, 1982

[51] Int. Cl.[3] ..... G10D 1/08; G10D 3/04

[52] U.S. Cl. ..... 84/173; 84/1.16; 84/267; 84/291; 84/293; 84/297 R; 84/299; 84/307

[58] Field of Search ..... 84/173, 263, 267, 291, 84/293, 298–299, 307–309, 1.16

[56] References Cited

U.S. PATENT DOCUMENTS

| | | | |
|---|---|---|---|
| 1,647,312 | 11/1927 | Riller | 84/263 |
| 1,759,736 | 5/1930 | Dodson et al. | 84/263 |
| 1,759,779 | 5/1930 | Dodson et al. | 84/263 |
| 2,222,057 | 11/1940 | Benioff | 84/1.16 |
| 2,770,158 | 11/1956 | Bowman | 84/309 |
| 3,910,151 | 10/1975 | Copeland | 84/267 |
| 4,242,938 | 1/1981 | Van Zalinge | 84/1.16 |

FOREIGN PATENT DOCUMENTS 562350 10/1932 Fed. Rep. of Germany ..... 84/173

*Primary Examiner*—Lawrence Franklin

*Attorney, Agent, or Firm*—Richard L. Miller

[57] ABSTRACT

There is provided a novel stringed musical instrument for direct attachment to an electronic transducer. An elongated member is mounted on a frame on which is also mounted an upright bridge having string gripping means for positioning, gripping and passing the vibrations of a plurality of strings connected on one side of the bridge to the elongated member and on the other side of the bridge to string holding means for holding and tensioning the strings. An electronic transducer is mounted at the bridge means, which passes vibrations received from the plucked strings to the transducer, from which the sounds are amplified and sent to speakers. In addition, hand grips on the frame are disposed proximate to the bridge means, which configures the gripping means so as to position the strings within finger reach of the hand grips.

4 Claims, 9 Drawing Figures

STRINGED INSTRUMENT FOR ATTACHMENT TO AN ELECTRONIC TRANSDUCER

BACKGROUND OF THE INVENTION

This invention relates generally to stringed musical instruments and in particular to a stringed musical instrument that is adapted to be connected to an electronic amplifier.

It is well known that popular music is associated with electronic amplification, most particularly stringed instruments such as guitars. The stringed musical instrument generally used have been traditionally constructed ones having a sound box. The sound box has been used in many such instruments throughout history in order to amplify the sound made by the plunked strings. With the coming of electronic amplification, however, the sound box is no longer necessary but for traditional reasons has been contained to be used by musicians even though the sound of the strings is amplified by electronic transducers for transmittal to speakers.

Furthermore, electronic amplification by the doing away of the necessity of the traditional sound box, has made possible the elimination of the conventional awkward configurations and resulting relative immobility of the hands necessitated by the presence of the sound box during performances when the instrument is hand carried.

SUMMARY OF THE INVENTION

Accordingly it is an object of the present invention to provide a stringed musical instrument that is adapted to transmit sound from its plucked strings directly to an electronic transducer from a vibration transmitter.

Another object of the invention is to provide a hand-plucked string musical instrument with two hand grips located in proximity to the transducer.

Yet another object of this invention is to provide a hand-plucked string instrument having strings mounted in a three-dimensional pattern on a bridge means, the bridge means being located in proximity to two hand grip, the bridge means being provided with a transducer that picks up vibration from the bridge.

Still another object of this invention is to provide a string-plucked musical instrument devoid of a sound box and provided with an electronic transducer for transmittal of the vibrating sound to amplifiers and speakers without having to go through a sound box before being picked up by the transducer.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENT

Figures 1, 2, 3, 4, 5, 6, 7, 8, 9:
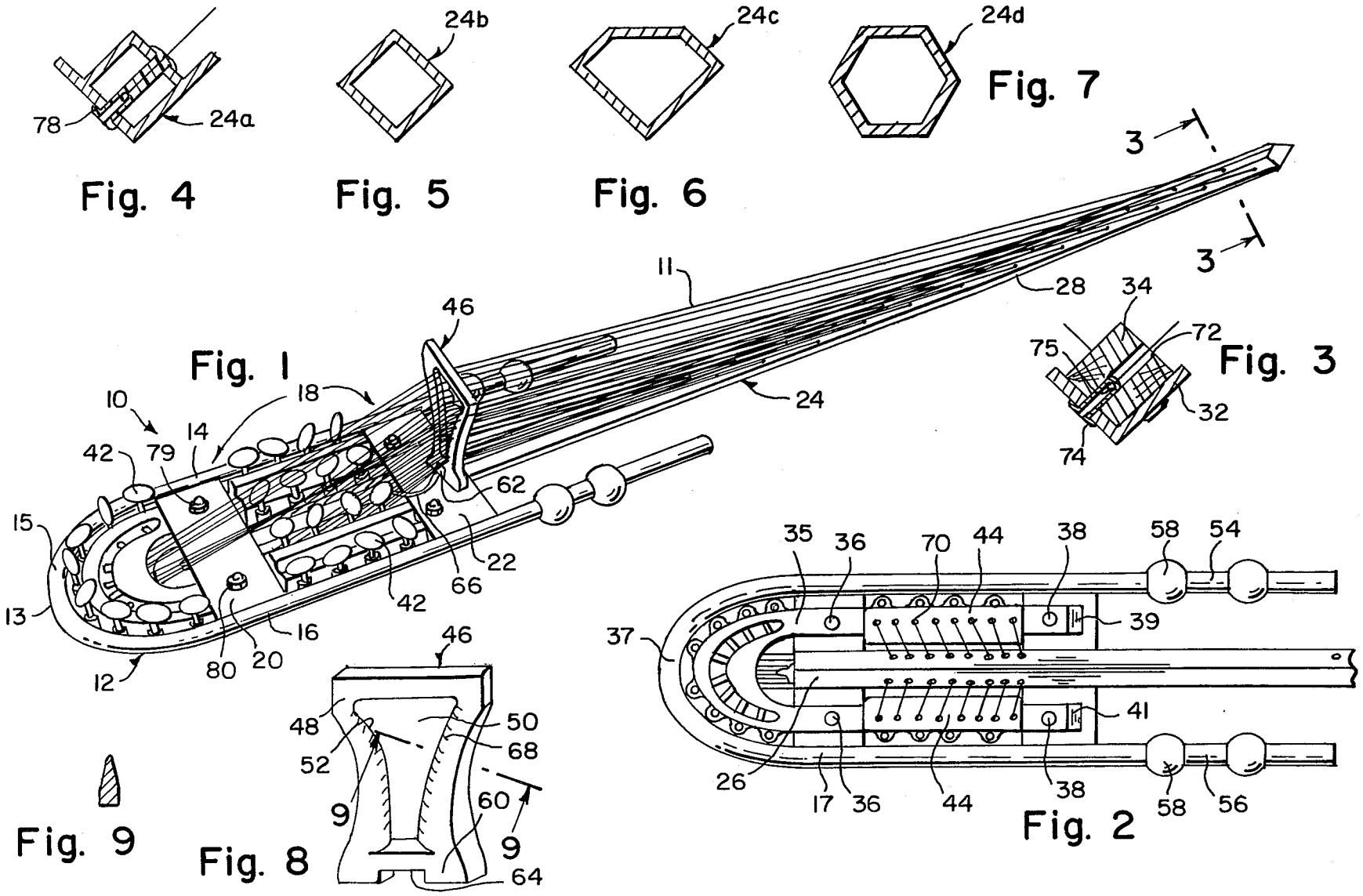
FIG. 1 is a perspective view showing the top side of the invention.
FIG. 2 is a broken away bottom view of a portion of the invention.
FIG. 3 is a cross sectional view taken along line 3—3 of FIG. 1.
FIGS. 4, 5, 6 and 7 are cross-sectional views similar to FIG. 3 illustrating variations of the construction of the elongated neck member.
FIG. 8 is an enlarged perspective view of a bridge means shown by itself for clarity.
FIG. 9 is a cross sectional view on line 9—9 of FIG. 8.

Reference is now made to the drawings in greater detail.

As shown in FIG. 1, reference numeral 10 indicates a stringed musical instrument according to the present invention; in particular, a stringed instrument having a plurality of tensioned strings 11 adapted to be plucked by hand or with a hand-held plucker. A mounting frame 12, which is configured in a U-shape with U-base 13, has two parallel arms 14 and 16 extending from either side of U-base 13. Frame 12 is preferably made of a round metal rod of lightweight material such as aluminum. The top side of frame 12 is designated by numeral 15 and the bottom side by numeral 17. A cross member means, 18 preferably includes two cross-members 20 and 22 mounted across the U-base formed by frame 12, with cross-member 20 being located closer to the U-base than cross-member 22. Cross members 20 and 22 are for rigidifying arms 14 and 16 and for mounting purposes as will be described.

An elongated, rigid neck member 24 has a near portion, 26, connected to cross-member means 18, preferably at the underside 17 of the cross-members 20 and 22 as shown in FIG. 2. Elongated member 24 is positioned mid-way between parallel arms 14 and 16 and runs parallel with them from cross-member 20 proximate to the base of the U-base outwardly from the opening, or gap, formed by the U-base to its far portion 28, opposite the near portion located distal from the cross-member means 18 and preferably past the ends of arms 14 and 16, as illustrated in FIG. 1. The distance that elongated member 24 extends from cross-member 18 can vary, depending on musical requirements. Elongated member 24 preferably includes elongated metal piece 32, which is shaped in a right-angle configuration when viewed in cross section, as shown in the detail of FIG. 3. Piece 32 is preferable made of the same material as frame 12, namely a lightweight metal such as aluminum. An elongated filler 34 is inserted into the inner space formed by the right angle of piece 32 and is bonded to piece 32 by conventional means (not shown). Filler 34 is preferably made of wood. Together, piece 32 and filler 34 form elongated member 24, which acts as a rigid guide and support. Member 34 has rectangular or square configuration when viewed in cross-section as in FIG. 3.

String holding means 35 is connected to bottom side 17 of frame 12, in particular by being bolted by means of bolt pairs 36 and 38 to the bottoms of cross-member means 18 at both cross-members 20 and 22 as shown in FIG. 2. String holding means 35 preferably has the same U-shaped configuration with U-shaped base 37 and parallel arms 39 and 41 as frame 12 and follows the inside of U-base 13 and arms 14 and 16, leaving a small space between them. String-holding means 35 is preferably made of wood but can be made of any suitable lightweight rigid material. A plurality of string-tuning devices 42 are mounted on the string-holding means 35 as shown in FIGS. 1 and 2. String holding means 35 preferably includes a pair of string guide means 44 mounted across from one another on the bottoms of arms 39 and 41. String guide means 44 are for leading selected strings to selected tuning devices 42, some of which are located in positions that would displace the strings from their paths if the strings were led directly to the tuning devices. String guide means 44 can be made of any suitable rigid material with low abrasion quality such as wood.

An upright bridge means 46 is mounted to top side 15 of frame 12, specifically at cross-member 22. Bridge means 46 is positioned between far portion 28 of elongated member 24 and string holding means 35. The exact position of bridge means 35 and far portion 28 can vary depending upon the musical requirements.

Bridge means 46, as illustrated in by itself in FIGS. 8 and 9 is a tapered upright block 48 with an aperture 50 with a perimeter 52 configured to string vibration requirements and also to finger lengths when the user is holding gripping areas 54 and 56 of arms 14 and 16. Gripping areas 54 and 56 are each optionally provided with a pair of spherical wooden grips 58 to aid a user in holding and positioning the instrument. Grips 58 are to be placed at the balance point of the instrument.

Block 48 forms mounting means 60 for securing an electronic transducer 62, preferably by way of a cavity 64 formed at the base of the block. As seen in FIG. 1, an electric cable 66 leads from the transducer to the underside of instrument 10 and to amplifiers and speakers (not shown).

One end of strings 11 are connected along far portion 28 of elongated member 24 at predetermined intervals. In accordance with the present invention, bridge means 46 receives and guides the strings at predetermined positions by way of a plurality of notches 68 formed around perimeter 52 of aperture 50, the notches being adapted to receive and position the strings and to transmit the vibrations of the plucked strings to the transducer. String holding means 35 receive the other end of the strings, specifically at string-tuning devices 42, after the strings pass through a plurality of eyelets 70 formed in string holding means 35 and paired string guide means 44. With the conventional tuning devices, the strings can be tensioned to requirements.

In accordance with the present invention, perimeter 52 of block 48 is configured to relate to the distance the strings would be from the gripping areas 54 and 56 of arms 14 and 16. As the user holds the instrument at the grips, the user's fingers would be able to reach the strings. The aperture is designed and arranged so that the strings are positioned alternately from bass on the top to treble on the bottom. Specifically, the configuration or curvature of the aperture is designed and arranged to conform to the curvature transcribed by the fingers when they perform a strumming motion while the hands are holding the instrument at grips 54 and 56.

Also, in accordance with the present invention, the sounds made by the strings are directly picked up by the electronic transducer and transmitted to the speakers without having been passed through a sound box. These sounds are transmitted directly to the transducer by the bridge means which vibrates in accordance with it.

Strings 11 are connected to elongated member 24 through holes 72 drilled through elongated member 24 as shown in FIG. 3. A brass eyelet 74 is positioned in the hole to receive the string. A small plastic bead 75 is positioned in the eyelet for centering the string and to prevent the abrasion of the string against the eyelet. The string ends in a knot. It is noted that the tension of the strings in this construction is towards the pressing together of piece 32 and filler 34.

Alternate elongated members 24 unitary construction is shown in FIGS. 4, 5, 6 and 7. FIG. 4 illustrates a modified through-the-member eyelet 78 with a unitary, hollow, elongated member **24*a* having right angles along with a top right-angled filler of lesser dimensions. FIG. 5 illustrates a unitary hollow elongated member 24*b* of square configuration. FIG. 6 illustrates a unitary, hollow, elongated member 24*c* of modified triangular configuration. FIG. 7 illustrates a unitary, hollow, elongated member 24*d*** of octagonal construction.

FIG. 1 illustrates a preferable position of volume and tone knob controls 79 and 80 at the top of cross-member 20. The transducer jack (not shown) is placed at the underside of elongated member 24 and is grounded to the metal position.

While certain novel features of this invention have been shown and described and are pointed out in the annexed claims, it will be understood that various omissions, substitutions and changes in the forms and details of the device illustrated and in its operation can be made by those skilled in the art with out departing from the spirit of the invention.

What is claimed is:

1. A stringed musical instrument for attachment to an electronic transducer, in combination comprising:

mounting frame means;

an elongated member having a near portion and a far portion, said near portion being connected to said frame means and said far portion extending outward from said frame means;

string holding means mounted to said frame means;

upright bridge means mounted to said frame means between said far portion and said holding means;

means connected to said bridge means for mounting an electronic transducer means and passing vibrations received by said bridge means to said transducer;

one end of said strings being connected along said far portion of said elongated member at predetermined intervals, said bridge means being for receiving and positioning said strings at predetermined positions and passing vibrations from said strings to said transducer and said holding means being for holding the other end of said strings and for tuning said strings, whereby when the strings are plucked, the resulting vibration passes directly to the transducer so that the sound can be passed directly to amplifying equipment and speakers; wherien said mounting frame means is a U-shaped member having parallel arms and cross-member means connected to said arms, said near portion of said elongated member being connected to the center of said cross-member means and extending parallel to said arms in the open end of said U-shaped member; and wherein said bridge means is a bridge mounted on the top side of said cross-member means and body, having a configured aperture provided with a plurality of string gripping means around the inner perimeter of said aperture, said strings being connected to said string-gripping means, said gripping means being for transmitting vibrations from said strings to said transducer.

2. The musical instrument according to claim 1, wherein said means for mounting an electronic transducer is a cavity formed at the base of said body.

3. The musical instrument according to claim 2 wherein said string holding means includes a mounting block connected to said cross-member means and a plurality of tuning devices connected to said block at predetermined intervals, said block including passage means for passing said strings from said aperture of said bridge body to said tuning devices.

4. The stringed musical instrument according to claim 1, wherein the configuration of said aperture is related to finger lengths from said parallel arms, whereby a user can hold the instrument at said arms and reach the strings for playing with the fingers or a plucker held by the fingers.

* * * * *